US008260157B2

(12) United States Patent
Kim et al.

(10) Patent No.: US 8,260,157 B2
(45) Date of Patent: Sep. 4, 2012

(54) IMAGE FORMING APPARATUS

(75) Inventors: Kyoung-Seok Kim, Hwaseong-Si (KR); Dong-Hun Han, Suwon-Si (KR); Yong-Geol Chung, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 290 days.

(21) Appl. No.: 12/782,243

(22) Filed: May 18, 2010

(65) Prior Publication Data

US 2011/0091222 A1 Apr. 21, 2011

(30) Foreign Application Priority Data

Oct. 15, 2009 (KR) ..... 10-2009-0098022

(51) Int. Cl.
*G03G 15/00* (2006.01)

(52) U.S. Cl. ..... 399/9; 399/12; 399/13; 399/107

(58) Field of Classification Search ..... 399/9, 12, 399/13, 107
See application file for complete search history.

(56) References Cited

U.S. PATENT DOCUMENTS

| | | | | |
|---|---|---|---|---|
| 4,839,691 | A * | 6/1989 | Tagawa et al. | 399/12 |
| 6,549,731 | B1 * | 4/2003 | Yoshida et al. | 399/12 |
| 7,321,739 | B1 * | 1/2008 | Dawson et al. | 399/90 |
| 2006/0120746 | A1 | 6/2006 | Lee et al. | |

FOREIGN PATENT DOCUMENTS

| | | |
|---|---|---|
| KR | 10-2006-0063131 | 6/2006 |
| KR | 10-2007-0067559 | 6/2007 |

OTHER PUBLICATIONS

English language abstract of KR 10-2006-0063131, published Jun. 12, 2006.
English language abstract of KR 10-2007-0067559, published Jun. 28, 2007.

* cited by examiner

*Primary Examiner* — Hoang Ngo
(74) *Attorney, Agent, or Firm* — Staas & Halsey LLP

(57) ABSTRACT

Disclosed is an image forming apparatus including a body housing in which an opening is formed for providing removal/mounting access of a removable cartridge; a door member for selectively closing the opening. The removable cartridge includes a cartridge status chip in which predetermined information relating to the removable cartridge is recorded. The door member of the image forming apparatus and the removable cartridge may each be provided with respective contact terminal or terminals that engage when the door member is closed with the removable cartridge received in the body housing of the image forming apparatus. The controller of the image forming apparatus uses the electrical continuity information of the contact terminal or terminals in order to determine the closure status of the door member and to control the operation of the image forming apparatus accordingly.

20 Claims, 6 Drawing Sheets

IMAGE FORMING APPARATUS

CROSS-REFERENCE TO RELATED APPLICATIONS

This application claims priority from Korean Patent Application No. 10-2009-0098022, filed on Oct. 15, 2009 in the Korean Intellectual Property Office, the disclosure of which is incorporated herein by reference.

TECHNICAL FIELD

The present disclosure relates generally to an image forming apparatus for forming an image on a printing medium, and, more particularly, to an image forming apparatus capable of detecting the closure state of a door for an access opening of the housing of the image forming apparatus.

BACKGROUND OF RELATED ART

Example implementations of an image forming apparatus that uses developer, ink or the like to form an image on a printing medium may include a printer, a copier, a facsimile machine, a so-called multifunction printer (MFP) that combines the functionalities of two or more of the aforementioned. Inside the body housing, which defines the general overall exterior appearance of an image forming apparatus, various components used in forming the image are accommodated and supported. An access opening is typically provided in the body housing to allow access to those internal components. For example, in an electro-photographic type image forming apparatus, when the supply of the developer used for forming the images is exhausted, it is necessary to replenish the developer supply or to replace the developing cartridge containing a fresh supply of developer. There may be other internal components such as, for example, the image carrier and other rollers, that may wear out overtime and that are thus designed to be replaceable or serviceable. The removal of a jammed printing medium may be another example that may require an internal access to the body housing.

A door or cover is also provided to selectively close the access opening so as to protect the internal components from dust, moisture and the like, that may be detrimental to the quality of image or that may even cause damages to the image forming apparatus. Operating the image forming apparatus with the access opening uncovered may also expose the user to hazardous conditions as some of the internal components during operation may be moving at a fast rate or may have applied thereto a high voltage.

It may thus be necessary to detect the opening of the door, and to control the operation of the image forming apparatus based on the detection, for example, pausing the image forming operation, for the purposes of reducing the risk of putting a user in danger and/or for the purposes of reducing the degradation in the image quality.

SUMMARY OF DISCLOSURE

According to one aspect of the present disclosure, there may be provided an image forming apparatus that may include a body housing having formed thereon an opening, a door member moveable so as to selectively open and close the opening, at least one developing cartridge, at least one terminal member and a controller. The at least one developing cartridge may be detachably receivable in the body housing through the opening, and may include a cartridge status chip having stored therein an operational state information relating to the at least one developing cartridge. The at least one terminal member may be arranged on the door member so as to come into contact with at least one cartridge terminal provided on the cartridge status chip when the door member is closed. The controller may be electrically connected to the at least one terminal member, and may be configured to make available an electrical power for, and to receive the operational state information from, the cartridge status chip through the contact between the at least one terminal member and the at least one cartridge terminal of the cartridge status chip, and to determines whether the door member is opened or closed based on whether the electrical power made available is being consumed.

The controller may be configured to determine that the door member is closed if it is determined that the electrical power is being consumed, and to determine that the door member is opened if it is determined that the electrical power is not being consumed.

The image forming apparatus may further comprise a power supplying unit received in the body housing. The power supplying unit may be configured to output an operational electrical power with which to operate one or more components of the image forming apparatus. The controller may be configured to prevent the power supplying unit from outputting the operational electrical power if it is determined that the door member is opened and to allow the power supplying unit to output the operational electrical power if it is determined that the door member is closed.

The cartridge status chip may include a customer replaceable unit monitor (CRUM) memory storing therein the operational state information.

The at least one cartridge terminal may each include a first through third cartridge terminals. The operational sate information may be transmitted through first cartridge terminal. The operating supply power with which the cartridge status chip being operable to provide the operational state information to the controller may be received through the second cartridge terminal. The third cartridge terminal may be configured to receive therethrough the electrical power made available by the controller. The controller may determine that the door member is open based at least in part on determination that the electrical power is not being drawn by the third cartridge terminal.

The at least one cartridge terminal may further include a fourth cartridge terminal connected to a common ground for the operating supply power and the electrical power.

The at least one developing cartridge may comprise a plurality of developing cartridges each containing developer of a color different from developer contained in other ones of the plurality of developing cartridges. The at least one terminal member may comprise a plurality of terminal members corresponding to the plurality of developing cartridges. The plurality of terminal members may each be configured to come into contact with the at least one cartridge terminal of the cartridge status chip of respective corresponding one of the plurality of developing cartridges.

The image forming apparatus may further comprise a power supplying unit that may be configured to output a plurality of levels of voltages each for operating different one or more components of the image forming apparatus. The controller may be configured to sequentially block ones of the plurality of levels of voltages from being applied to corresponding ones of the one or more components of the image forming apparatus based on an order in which the third cartridge terminal of ones of the plurality developing cartridges is released from corresponding ones of the plurality of terminal members.

According to another aspect of the present disclosure, an image forming apparatus having an access opening formed on the main housing thereof for providing mounting access therethrough of one or more removable components of the image forming apparatus may be provided so as to include a door coupled to the main housing in such a manner as to be moveable selectively to open and to close the access opening, one or more electrical contact terminals arranged on a side of the door facing the access opening and a controller. The one or more electrical contact terminals may be arranged on the side of the door in such a manner the one or more electrical contact terminals come into an electrical contact with at least one of component contact terminals formed respectively on the one or more removable components received in the main housing when the door is closed. The controller may be configured to control the operation of the image forming apparatus based at least in part on a determination of whether an electrical current flows through the one or more electrical contact terminals.

The one or more electrical contact terminals may comprise a first electrical contact terminal and a second electrical contact terminal. The controller may be configured to interrupt supply of power to a first internal component of the image forming apparatus in response to determination that no electrical current is flowing through the first electrical contact terminal and to interrupt supply of power to a second internal component of the image forming apparatus in response to determination that no electrical current is flowing through the second electrical contact terminal.

The operating voltage of the first internal component of the image forming apparatus may be higher than that of the second internal component of the image forming apparatus. The door may be rotatable about a rotational axis. The first electrical contact terminal may be positioned further away from the rotational axis of the door than the second electrical contact terminal.

The first internal component of the image forming apparatus may alternatively be configured to emit a light. The door may be rotatable about a rotational axis. The first electrical contact terminal may be positioned furthest away from the rotational axis of the door among all of the one or more electrical contact terminals.

The one or more removable components may comprise a developer cartridge in which a supply of developer of at least one color is stored.

According to yet another aspect of the present disclosure, a removable component unit of an image forming apparatus, which may be detachably receivable in a main housing of the image forming apparatus through an access opening formed on the main housing that includes a door for selectively closing the access opening, may be provided to include a unit housing and at least one electrical contact terminal. The unit housing may have housed therein a memory device in which information relating to the removable component unit is stored. The at least one electrical contact terminal may be arranged on the unit housing so as to be engageable with an electrical terminal provided on the door, and may form at least a part of an electrical current path between the at least one electrical contact terminal and an electrical ground to which a ground terminal of the memory device is connected.

The removable component unit may in one example comprise a developer cartridge in which a supply of developer of at least one color is stored. The memory device may comprise a customer replaceable unit monitor (CRUM) memory for storing therein information relating to an amount of developer contained in the developer cartridge.

The at least one electrical contact terminal may comprises a first electrical contact terminal for receiving therethrough an operating supply voltage for the memory device and a second electrical contact terminal different from the first electrical contact terminal.

The electrical current path between the at least one electrical contact terminal and the electrical ground may comprise a resistive current path.

The at least one electrical contact terminal may comprises at least two electrical contact terminals that are electrically connected with each other.

The developer cartridge may contain therein yellow color developer.

Alternatively, the developer cartridge may contains therein magenta color developer.

BRIEF DESCRIPTION OF THE DRAWINGS

Various features and aspects of the present disclosure will become apparent and more readily appreciated from the following description of several embodiments thereof, taken in conjunction with the accompanying drawings, in which.

DETAILED DESCRIPTION OF SEVERAL EMBODIMENTS

Figure 1:
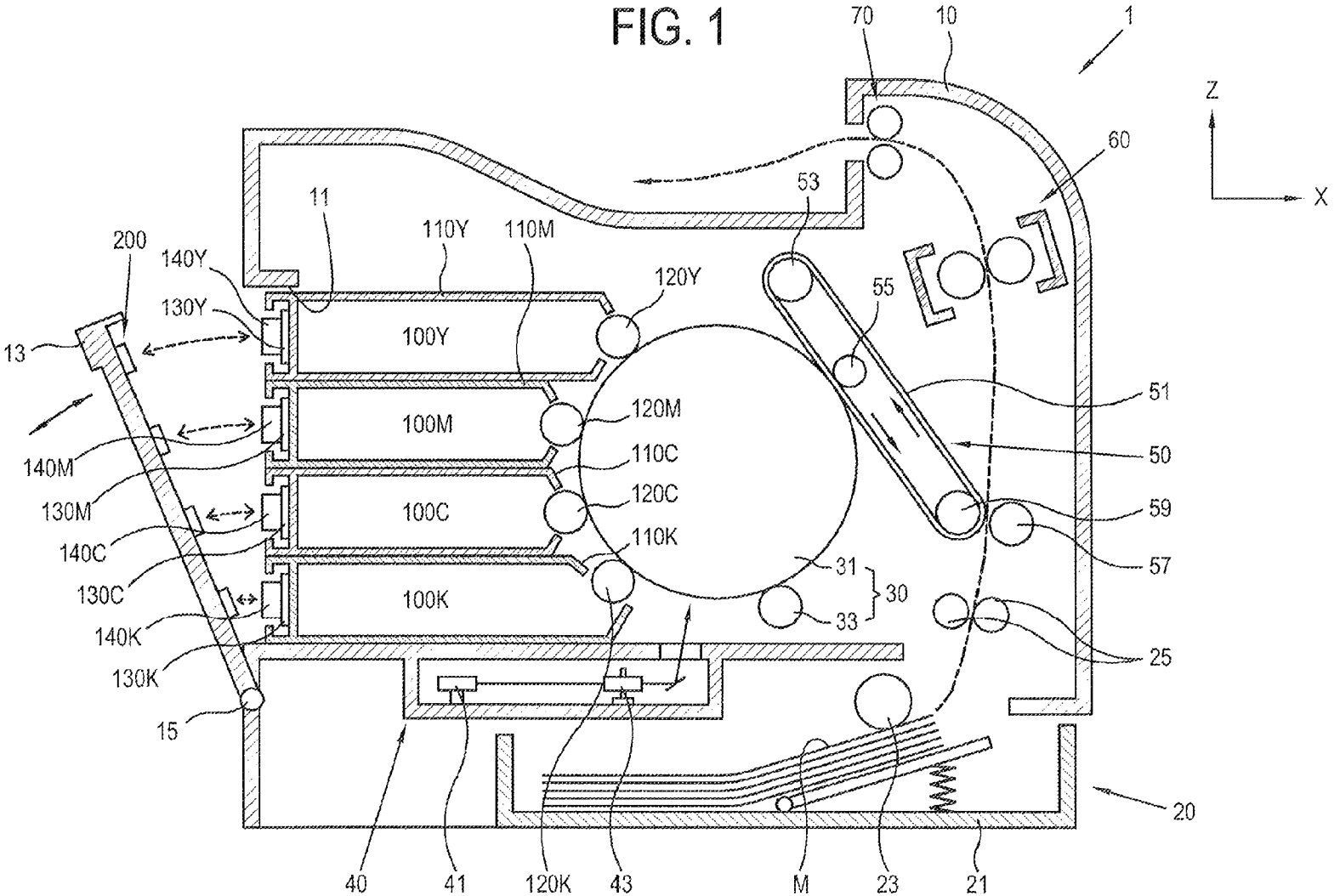
FIG. 1 is a side sectional view of an image forming apparatus according to a an embodiment of the present disclosure.

Reference will now be made in detail to several embodiments of the present invention, examples of which are illustrated in the accompanying drawings, wherein like reference numerals refer to like elements, the descriptions thereof may not be repeated. While the embodiments are described with detailed construction and elements to assist in a comprehensive understanding of the various applications and advantages of the embodiments, it should be apparent however that the embodiments can be carried out without those specifically detailed particulars. Also, well-known functions or constructions will not be described in detail so as to avoid obscuring the description with unnecessary detail. It should be also noted that in the drawings, the dimensions of the features are not necessarily intended to be to true scale and may be exaggerated for the sake of allowing greater understanding.

FIG. 1 is a side sectional view of an image forming apparatus 1 according to an embodiment of the present disclosure, which is implemented as a printer of an electro-photographic type that forms a color image on a printing medium M using developer of different colors. The image forming apparatus 1 may include a body housing 10 that generally defines the overall outer appearance of the image forming apparatus 1, a medium supplying unit 20 configured to supply printing media M loaded thereon along a printing media transport path defined in the body housing 10, a photosensitive unit 30, which may include an image carrier 31 and a charge roller 33 that charges the image carrier 31 to an electrical potential, an exposure unit 40 configured to exposes the image carrier 31 with light in correspondence to image data so as to form an electrostatic latent image on the image carrier 31; developing cartridges 100Y, 100M, 100C and 100K for developing the electrostatic latent image with developer to thereby form a visible image on the image carrier 31, a transfer unit 50 configured to transfer the visible image from the image carrier 31 onto the printing medium M, a fixing unit 60 configured to fix the transferred image on the printing medium M and a medium discharging unit 70 operable to discharge the printing medium M bearing the fixed image out of the body housing 10.

The developing cartridges 100Y, 100M, 100C and 100K accommodated in the body housing 10 may each form a visible image on the image carrier 31 by supplying a developer of respective corresponding one of several colors to the electrostatic latent image of the image carrier 31. For example, according to an embodiment, developing cartridges 100Y, 100M, 100C and 100K may correspond respectively to four colors, yellow, magenta, cyan and black.

The body housing 10 may accommodate therein various components of the image forming apparatus 1 as illustrated in FIG. 1. The body housing 10 may be provided with an opening 11 through which the developing cartridges 100Y, 100M, 100C and 100K may be received into, and/or removed from, the body housing 10, and may further be provided with a door member 13 for opening and closing the opening 11. The door member 13 may be rotatably supported on the body housing 10 so as to rotate about the hinge 15 toward and away from the body housing 10 to thereby open and close the opening 11.

The medium supplying unit 20 may be detachably received in the body housing 10, and may include a loading cassette 21 for loading thereon the printing media M; a pick-up roller 23 that is configured to pick up the printing media M loaded on the loading cassette 21 one by one and a registration roller 25 for conveying the picked printing medium M along the printing medium transport path in the direction of the transfer unit 50 at the appropriate timing.

An electrostatic latent image is formed on the image carrier 31 as a pattern of potential differences when its surface previously charged to a uniform potential by the charge roller 33 is exposed to a light pattern from the exposure unit 40 that correspond to the desired image. To that end, the image carrier 31 may be arranged in a predetermined position relative to the developing cartridges 100Y, 100M, 100C and 100K, and receive developer of respective corresponding individual one of the several colors from each of the developing cartridges to form thereon a visible image of full color as an overlapping combination or superimposition of the individual color images received from each of the developing cartridges 100Y, 100M, 100C and 100K.

The exposure unit 40 may include a light source 41 that is selectively turned on/off in correspondence to image data and a polygon mirror 43 that deflects the light beam emitted from the light source 41 in such a manner the light beam is scanned across the charged surface of the image carrier 31. As the image carrier 31 is made to rotate, the scanning of the lines of the light beam across the surface of the image carrier 31 results in a pattern of electrical potential difference, thus resulting in the formation of the electrostatic latent image on the image carrier 31.

In a color image printing operation, the exposure unit 40 may divide the image data into several sets of data each for an individual color, and may sequentially exposes the image carrier 31 according to the data for each individual color for each revolution of the image carrier 31.

For example, the exposure unit 40 may divide the image data corresponding to the image to be formed on a sheet of printing medium M into four sets of data corresponding respectively to yellow, magenta, cyan and black images. The exposure unit 40 may scan the image carrier 31 with the light beam based on the yellow image data during the first rotation of the image carrier 31, the magenta image data during the second rotation of the image carrier 31, the cyan image data during the third rotation of the image carrier 31 and the black image data during the forth rotation of the image carrier 31, for example. That is, the image carrier 31 is rotated four times to form the electrostatic latent image that is representative of all four individual color image.

The developing cartridges 100Y, 100M, 100C and 100K may be received into or removed from the body housing 10 through the opening 11. According to an embodiment shown in FIG. 1, the four developing cartridges 100Y, 100M, 100C and 100K may be, for example, supported in the body housing 10 with the developing cartridges vertically stacked on one another.

The developing cartridges 100Y, 100M, 100C and 100K form visible images of respective colors by supplying developers of respective colors to the respective electrostatic latent images on the image carrier 31. Similarly with the operation of the exposure unit 40 as described above, the developing cartridges 100Y, 100M, 100C and 100K form the visible images of the four colors while the image carrier 31 rotates four times.

For example, for forming a color image on one printing medium M, the yellow developing cartridge 100Y, the magenta developing cartridge 100M, the cyan developing cartridge 100C and the black developing cartridge 100K supply the developer of the yellow, magenta, cyan and black colors to the corresponding electrostatic latent image on the image carrier 31 respectively during the first, second, third and fourth rotation of the image carrier 31.

The developing cartridges 100Y, 100M, 100C and 100K may include respective cartridge housings 110Y, 110M, 110C and 110L, in which to store the respective developers; and respective developing rollers 120Y, 120M, 120C and 120K placed in the front portion of the respective cartridge housing 110Y, 110M, 110C and 110K for supplying the respective developers to the image carrier 31. The developing cartridges may also include cartridge status chips 130Y, 130M, 130C and 130K placed in the rear portion of the respective cartridge housing 110Y, 110M, 110C and 110K for recording the operational state information related to the respective developing cartridges 100Y, 100M, 100C and 100K; and respective cartridge terminals 140Y, 140M, 140C and 140K that are connected to the respective cartridge status chips 130Y, 130M, 130C and 130L, and that extend toward the rear sides of the respective cartridge housings 110Y, 110M, 110C and 110K.

According to an embodiment, the developing cartridges 100Y, 100M, 100C and 100K for the respective colors may be separable from one another, and may be arranged along the rotation direction of the image carrier 31. For example, the developing cartridges 100Y, 100M, 100C and 100K for the respective colors may be vertically stacked along the Z direction as shown in FIG. 1.

The transfer unit 50 according to an embodiment may include a transfer belt 51; a belt driving roller 53 for rotationally driving the transfer belt 51, an intermediate transfer roller 55 arranged to correspondingly oppose the image carrier 31 with the transfer belt interposed therebetween so as to transfer the visible image on the image carrier 31 onto the transfer belt 51, a final transfer roller 57 which transfer a final image on the transfer belt 51 onto the printing medium M and a transfer backup roller 59 opposing the final transfer roller 57.

According to an embodiment, while the image carrier 31 rotates four times as previously described, the transfer belt 51 also correspondingly rotates four times so that the respective color images formed on the image carrier 31 are transferred onto the transfer belt 51 in such a manner overlapping one another to manner so that the final image, which is a superposition of the four individual color visible images, is formed on the transfer belt 51 after the completion of the four rotations of the image carrier 31.

At this point, the registration roller 25 conveys the printing medium M to the final transfer roller 57 which then transfers the final color image from the transfer belt 51 onto the printing medium M. The printing medium M to which the image has been transferred passes through the fixing unit 60 that fixes the transferred image on the printing medium, and is discharged by the medium discharging unit 70, thereby completing the printing operation.

Over time, the supply of developer in the developing cartridges 100Y, 100M, 100C and 100K may be exhausted in repeated printing operations. In addition, components such as, for example, the developing rollers 120Y, 120M, 120C and 120K in the developing cartridges 100Y, 100M, 100C and 100K may be worn out or may become deformed after the rated number of printing operations are performed. It may thus be necessary to replace a worn out or spent developing cartridge(s) time to time in order to ensure consistent image quality.

When a number of developing cartridges, such as the developing cartridges 100Y, 100M, 100C and 100K, are provided for supplying respective one of different colors, since the amount of developer being used up may be different for each color, the different developing cartridges 100Y, 100M, 100C and 100K may need to be replaced at different times. According to an embodiment, the required timing of the replacement of the developing cartridges 100Y, 100M, 100C and 100K may be determined based on the operational state information for each of the developing cartridges 100Y, 100M, 100C and 100K.

The operational state information may include information relating to, for example, the authenticity of the developing cartridge, the manufacture date of the developing cartridge, the initial amount of developers stored, the amount of developers that has been used up, the remaining amount of developers, various properties of developers, expected or rated operational life of various internal components, or other various kinds of information with respect to the developing cartridges 100Y, 100M, 100C and 100K, some of which may be consulted during various stage(s) of the printing operation.

Such operational state information may be recorded for each of the developing cartridges 100Y, 100M, 100C and 100K, and may be read and/or updated after the performance of one or more the printing operations. To that end, the developing cartridges 100Y, 100M, 100C and 100K may include the cartridge status chips 130Y, 130M, 130C and 130K, respectively, for recording therein such operational state information.

The cartridge status chips 130Y, 130M, 130C and 130K may be supplied with the operational state information, and may also receive the operational power, through the respective cartridge terminals 140Y, 140M, 140C and 140K, accessible from the rear of the developing cartridges 100Y, 100M, 100C and 100K. As shown in FIG. 1, the cartridge terminals 140Y, 140M, 140C and 140K may be disposed to face the door member 13 through the opening 11.

The image forming apparatus 1 may further include a terminal unit 200 provided on the inner surface of the door member 13 to correspondingly face the cartridge terminals 140Y, 140M, 140C and 140K. When the door member 13 is closed, the terminal unit 200 may become in contact with the cartridge terminals 140Y, 140M, 140C and 140K to establish the electrical communicative connection with the respective cartridge terminals 140Y, 140M, 140C and 140K of the respective developing cartridges 100Y, 100M, 100C and 100K. On the other hand, when the door member 13 is open, the electrical connections between the terminal unit 200 and the cartridge terminals 140Y, 140M, 140C and 140K is open.

Figure 2:
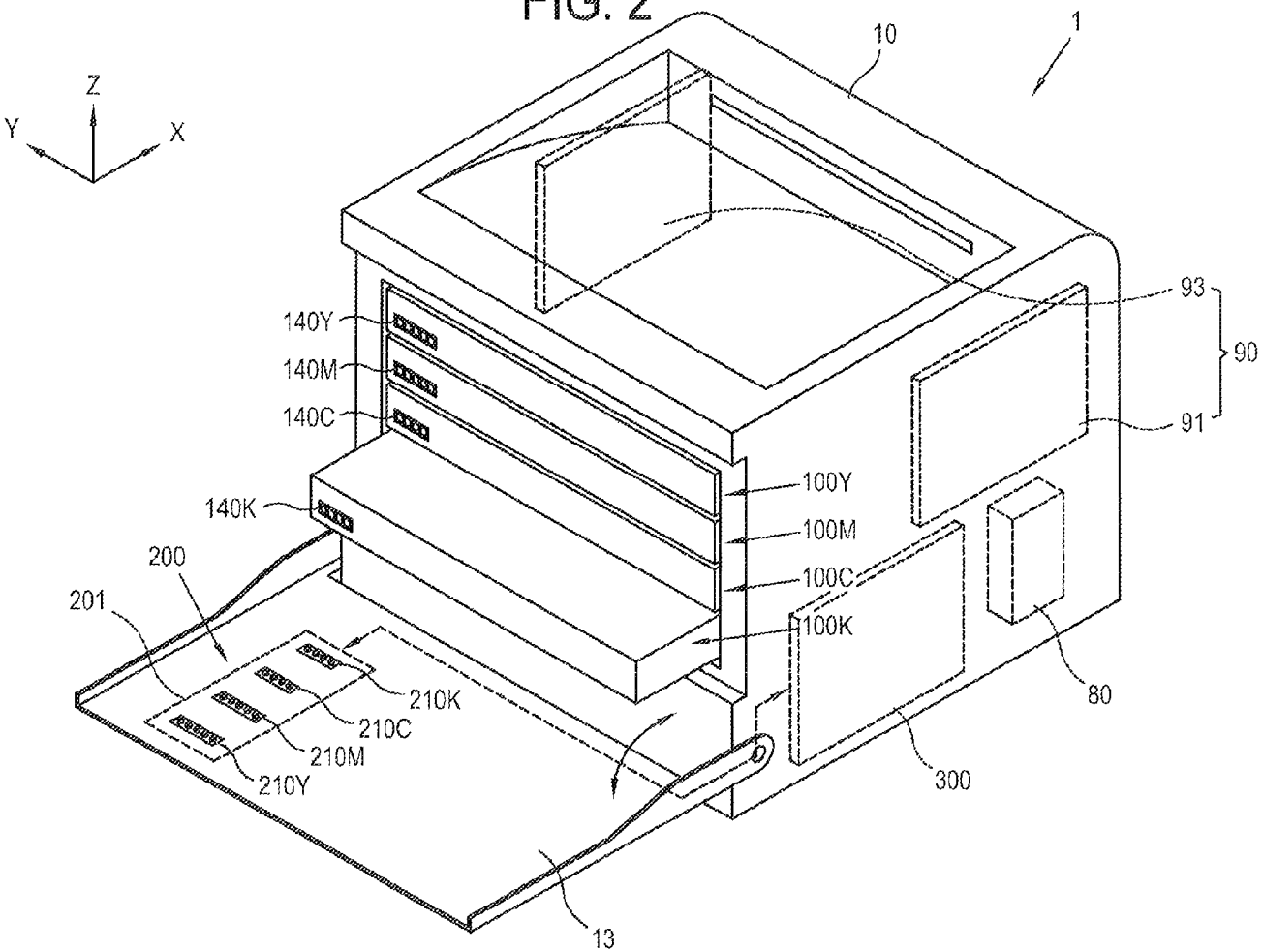
FIG. 2 is a perspective view of the image forming apparatus of FIG. 1 with the access door open.

Referring now to FIG. 2, which is a perspective view of the image forming apparatus 1 according to an embodiment, with its door member 13 open, the image forming apparatus 1 may further include a motor 80, a power supplying unit 90 configured to supply electrical power to the various components of the image forming apparatus 1 and a controller 300 configured to control the operations of the various components during the printing operations.

The motor 80 may generate the driving forces for moving various components, including, for example, for rotationally driving various rollers of the image forming apparatus 1. For example, the motor 80 may generate a driving force to rotate one or more of the pickup roller 23, the image carrier 31, the charge roller 33, the developing rollers 120Y, 120M, 120C and 120K, the belt driving roller 52, the polygon mirror 43 and the like. The driving force generated by the motor 80 may be delivered through various driving transmission gear(s) (not shown).

While for the sake of brevity, the image forming apparatus 1 according to an embodiment is described as employing a single motor 80 for the delivery of the driving force to its various component, it should be understood that, according to alternative embodiments, two or more motors 80 may be employed to drive the movements of the movable components of the image forming apparatus.

The power supplying unit 90 may receive electrical power from an external alternating current (AC) power source, and may convert the received AC power to various levels of AC or direct current (DC) power to be supplied to various components of the image forming apparatus 1. To that end, for example, the power supplying unit 90 may include a switching mode power supply (SMPS) 91 configured to output a relatively lower voltage and a high voltage power supply (HVPS) 93 configured to output a relatively higher voltage.

For example, without limitation to specific values, the SMPS 91 may output a 24V voltage for driving the motor 80 and a 5V voltage for switching on/off the light source 41. The HVPS 93 may provide the electrical power to various components that perform those operations such as, for example, charging, developing, transferring and the like, that require the application of a higher voltage, and may supply power to, for example, the charge roller 33, the image carrier 31, the developing rollers 120Y, 120M, 120C and 120K, the intermediate transfer roller 55 and the final transfer roller 57.

The terminal unit 200 may include a terminal substrate 201 provided on the door member 13 and terminal members 210Y, 210M, 210C and 210K arranged on the terminal substrate 201 to correspond to the cartridge terminals 140Y, 140M, 140C and 140K of the respective developing cartridges 100Y, 100M, 100C and 100K. The terminal members 210Y, 210M, 210C and 210K may be electrically connected to the controller 30 through the terminal substrate 201.

Figure 3:
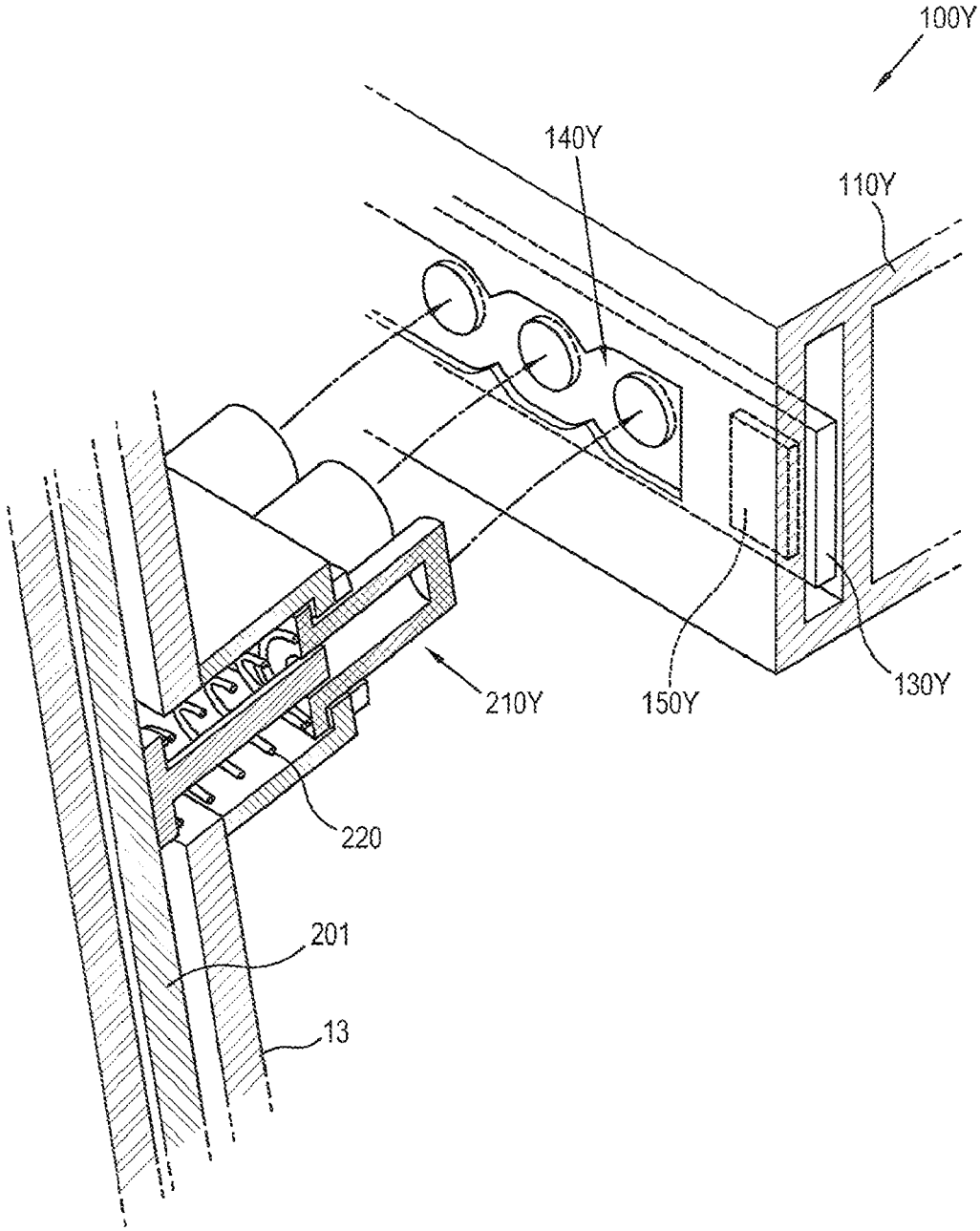
FIG. 3 is a sectional view showing a structure of a terminal member and a cartridge terminal of an image forming apparatus according to an embodiment of the present disclosure.

FIG. 3 is a sectional view showing the structure of the terminal member 210Y and the cartridge terminal 140Y in greater detail. Although, for brevity sake, only the yellow developing cartridge 100Y and the corresponding terminal member 210Y are illustrated in FIG. 3 and described below, such description is similarly applicable to the developing cartridges of other colors.

As shown in FIG. 3, the cartridge status chip 130Y may be built into the rear of the developing cartridge 100Y, and may include a cartridge memory 150Y and one or more cartridge terminals 140Y.

The cartridge memory 150Y may be implemented as a customer replaceable unit monitoring (CRUM) memory known to those skilled in the art, and may include a nonvolatile EEPROM or the like for storing the previously described operational state information of the developing cartridge 100Y.

The cartridge terminal(s) 140Y may be exposed from the cartridge housing 110Y in a manner to face the door member 13. The cartridge terminal(s) 140Y may be placed to correspond to the terminal member 210Y, may allow therethrough the transmission of the operational state information and/or control signals, such as, for example, clock signals, between the cartridge chip 130Y and the controller 300, and may allow therethrough the supply of operational power, ground and/or the like to the cartridge chip 130Y.

The terminal substrate 201 may be arranged on one side of the door member 13, and may support thereon the terminal member(s) 210Y electrically connected thereto that face the cartridge terminal 140Y and one or more springs 220 that elastically biases the respective associated terminal member 210Y toward the corresponding cartridge terminal 140Y and away from the terminal substrate 201.

When the door member 13 is closed, the terminal member(s) 210Y contact(s) the cartridge terminal(s) 140Y, and accordingly, an electrical conduction path is established between the cartridge status chip 130Y and the controller 300. According to an embodiment, the elastic pressure by the spring(s) 220 is provided to improve the reliability of the contact between the terminal member 210Y and the cartridge terminal 140Y.

Figure 4:
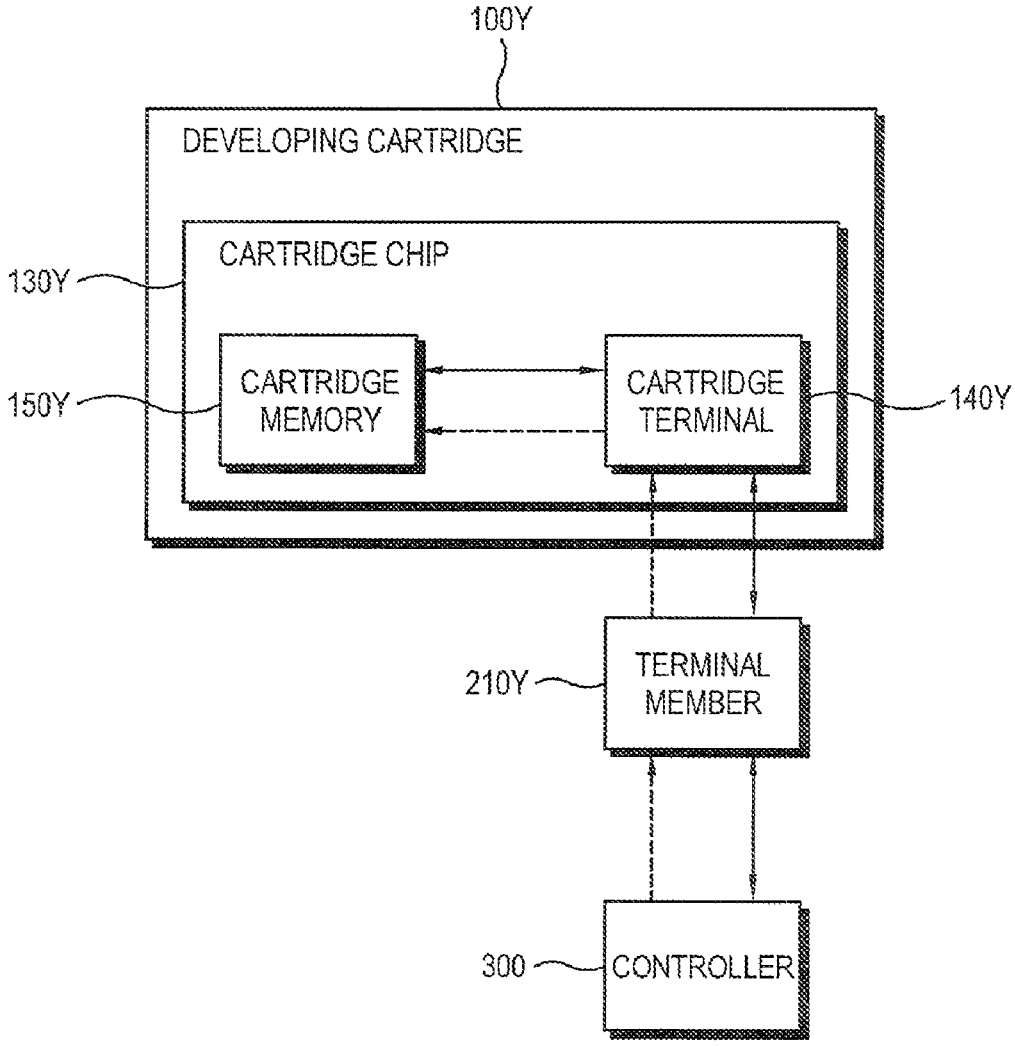
FIG. 4 is a block diagram illustrative of the communication and power supplying configuration of a controller and a cartridge chip of an image forming apparatus according to an embodiment of the present disclosure.

FIG. 4 is a functional block diagram illustrative of the communication and power supplying relationships between the controller 300 and the cartridge status chip 130Y during a printing operation. In FIG. 4, solid arrows represent the relationships with respect to the transmission of the operational state information, whereas the dotted arrows represent the power supplying relationships.

As shown in FIG. 4, when the door member 13 is closed, and when thus the electrical connection is made between the cartridge status chip 130Y and the controller 300, a predetermined level of supply voltage, for example, a 3.3V, may be applied to the cartridge status chip 130Y through the terminal member 210Y and the cartridge terminal 140Y.

The cartridge memory 150Y may become operational by the supply voltage, e.g., 3.3V, being applied to the cartridge chip 130Y, and may, accordingly, allow the controller 300 to receive the operational state information of the developing cartridge 100Y from the cartridge memory 150Y and to use the received information to control the printing operation. The controller 300 may update the operational state information in the cartridge memory 150Y as necessary based on the performance of the printing operation. As previously mentioned, this above process may be applicable to other developing cartridges for colors other than yellow.

The door member 13 mat be required to be closed while the image forming apparatus 1 is operating to perform the printing operation. For example, when the door member 13 is open, it is possible for a user to receive an electric shock from the high voltage of the HVPS 93 or to sustain an injury from coming into contact with the moving internal components, for example, the motor 80, or from being exposed to the light emitted by the exposure unit 40. If the printing operation is performed with the door member 13 open, external light may interfere with the exposure of the image carrier 31 by the exposure unit 40, which may in turn result in the deterioration of the image quality. It is also possible to expose the image forming apparatus 1 to damages from an external impact.

Accordingly, according to an embodiment, the controller 300 may selectively control the operation of various components of the image forming apparatus 1 based on the closure state of the door member 13. According to an embodiment, the controller 300 may make the determination of whether the door member 13 is open or closed based on whether the terminal members 210Y, 210M, 210C and 210K are electrically connected to the respective cartridge terminals 140Y, 140M, 14C and 140K.

Figure 5:
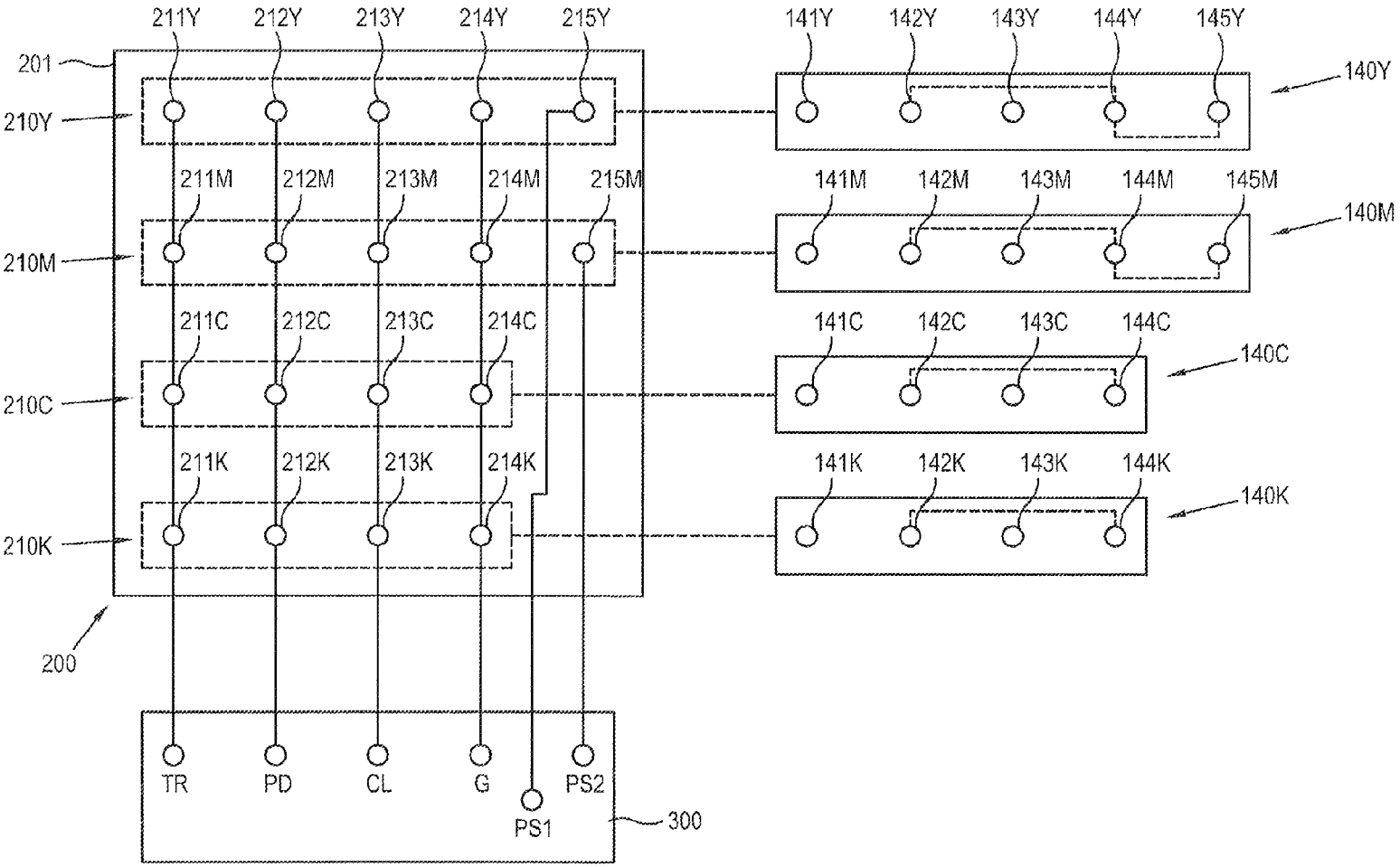
FIG. 5 is a schematic view illustrative of the configuration of the electrical connections between the controller, the terminal member and the cartridge terminal of an image forming apparatus according to an embodiment of the present disclosure.

Referring now to FIG. 5, which is schematic diagram of the electrical connections between the controller 300, the terminal members 210Y, 210M, 210C and 210K and the cartridge terminals 140Y, 140M, 140C and 140K. An illustrative example of the selective control of the operations of various components of the image forming apparatus 1 by the controller 300 based on the closure status of the door member 13 will be described.

As shown in FIG. 5, on the terminal substrate 201 are placed the terminal members 210Y, 210M, 210C and 210K corresponding to the respective cartridge terminals 140Y, 140M, 140C and 140K of the developing cartridges 100Y, 100M, 100C and 100K. The terminal members 210Y, 210M, 210C and 210K are electrically connected to the controller 300.

The terminal members 210Y, 210M, 210C and 210K include respective first terminals 211Y, 211M, 211C and 211K that are in common connection, respective second terminals 212Y, 212M, 212C and 212K commonly connected, respective third terminals 213Y, 213M, 213C and 213K commonly connected and respective fourth terminals 214Y, 214M, 214C and 214K that are commonly connected. The first terminals 211Y, 211M, 211C and 211K, second terminals 212Y, 212M, 212C and 212K, third terminals 213Y, 213M, 213C and 213K, and fourth terminals 214Y, 214M, 214C and 214K may contact the first cartridge terminals 141Y, 141M, 141C and 141K, the second cartridge terminals 142Y, 142M, 142C and 142K, the third cartridge terminals 143Y, 143M, 143C and 143K and the fourth cartridge terminals 144Y, 144M, 144C and 144K, respectively, of the cartridge terminals 140Y, 140M, 140C and 140K.

The first terminals 211Y, 211M, 211C and 211K may be connected to the data transmission terminal TR of the controller 300 so that the operational state information of the cartridge status chips 130Y, 130M, 130C and 130K can be transmitted to and/or received from, the controller 300.

The second terminals 212Y, 212M, 212C and 212K may be connected to the power supplying terminal PD of the controller 300 so that electrical power can be supplied to the cartridge status chips 130Y, 130M, 130C and 130K.

The third terminals 213Y, 213M, 213C and 213K may be connected to the clock signal terminal CL of the controller 300 so that reference clock signal(s) for the communication can be transmitted to the cartridge status chips 130Y, 130M, 130C and 130K.

The fourth terminals 214Y, 214M, 214C and 214K may be connected to the ground terminal G of the controller 300 so as to form a closed circuit in the operational electrical power along with the second terminals 212Y, 212M, 212C and 212K, the second cartridge terminals 142Y, 142M, 142C and 142K and the fourth cartridge terminals 144Y, 144M, 144C and 144K when the terminal members 210Y, 210M, 210C and 210*k* contact the cartridge terminals 140Y, 140M, 140C and 140K, respectively. To this end, the second cartridge terminals 142Y, 142M, 142C and 142K may be electrically connected to the fourth cartridge terminals 144Y, 144M, 144C and 144K, respectively.

According to an embodiment, the yellow and magenta terminal members 210Y and 210M, for example, may include the additional fifth terminals 215Y and 215M, respectively, whereas the corresponding yellow and magenta cartridge terminals 140Y and 140M may include the additional fifth cartridge terminals 145Y and 145M, respectively.

In the image forming apparatus 1 according to an embodiment, the developing cartridges 100Y, 100M, 100C and 100K may be stacked on another vertically while the door member 13 may be rotatably coupled to the lower side of the body housing 10. With such a configuration, when a closed door member 13 is opened by a user, the electrical open circuit between the cartridge terminals 140Y, 140M, 140C and 140K and the terminal members 210Y, 210M, 210C and 210*k* may occur in the order of yellow, magenta, cyan and black. Conversely, when an open door member 13 is closed by the user, electrical contacts between the cartridge terminals 140Y, 140M, 140C and 140K and the terminal members 210Y, 210M, 210C and 210*k* may be made in the order of black, cyan, magenta and yellow.

Further, according to an embodiment, as shown in FIG. 5, the yellow fifth terminal 215Y may be connected to the first power detection terminal PS1, through which the first detection power, for example, a predetermined level of voltage, may be supplied from the controller 300. The magenta fifth terminal 215M may be connected to the second detection power terminal PS2, through which the second detection power may be supplied from the controller 300. The level of voltage of the first and second detection power is not particularly limited to any specific value, and may be various voltage levels appropriate for the particular design or implementation of the image forming apparatus.

The corresponding fifth cartridge terminals 145Y and 145M are electrically connected to the corresponding fourth cartridge terminals 144Y and 144M, respectively, to thereby construct a closed circuit for the first or second detection power. In other words, the fourth cartridge terminals 144Y, 144M, 144C and 144K may constitute a common cathode or a common ground for the electrical power supplied through the second cartridge terminals 142Y, 142M, 142C and 142K and for the detection power supplied to the fifth cartridge terminals 145Y and 145M, or there may be provided a resistive current path between the corresponding ones of the fourth and fifth cartridge terminals.

When the printing operation starts in the initial condition where the door member 13 is closed, the controller 300 may control the power supplying unit 90 to apply power to the various components. For example, the SMPS 91 may be allowed to output a 5V voltage to turn on/off the light source 41 of the exposure unit 40 and to output a 24V voltage to drive the motor 80 while the HVPS 93 may be allowed to output a high voltage to various high voltage components, for example, the charge roller 33, the image carrier 31, the developing rollers 120Y, 120M, 120C and 120K, the intermediate transfer roller 55, the final transfer roller 57 and the like.

The controller 300 may supply the operational power to the cartridge status chips 130Y, 130M, 130C and 130K through the power supplying terminal PD, and may receive the operational state information from the cartridge status chips 130Y, 130M, 130C and 130K that are operating under the operational power through the data transmission terminal TR. The controller 300 may further supply the first and second detection power through the first and second detection power terminals PS1 and PS2, respectively. According to an embodiment, the printing operation may be performed to include such a series of processes by the controller 300.

When a user opens the door member 13 during a printing operation, with the above described arrangement of the developing cartridges 100Y, 100M, 100C and 100K, the yellow terminal member 210Y and the yellow cartridge terminal 140Y first separate from each other so as to become an open circuit.

Upon detecting that the first detection power through the first detection power terminal PS1 has open circuited, that is, the first detection power made available at the power terminal PS1 is no longer being consumed, drawn or otherwise conveyed from the power terminal PS1, the controller 30 may first block the high voltage output of the HVPS 93 and the 5V voltage output of the SMPS 91 so that, for example, the high voltage(s) applied to the various rollers and the light beam output from the exposure unit 40 are switched off or otherwise ceased or suspended.

When the user continues to open the door member 13 further, the magenta terminal member 210M and the magenta cartridge terminal 140M are next separated from each other.

Upon detecting that the second detection power through the second detection power terminal PS2 has become open circuited, the controller 30 may then block the 24V voltage output of the SMPS 91, so as to stop the operation of the motor 80.

In this manner, by detecting the electrical open circuit between the cartridge terminals 140Y, 140M, 140C and 140K and the terminal members 210Y, 210M, 210C and 210K, the controller 300 may be able to determines whether or not the door member 13 is open, and may selectively block the power output(s) of the power supplying unit 90 in the order of detection of the detection powers becoming open circuits. That is, according town embodiment, it is possible to determine whether the door member 13 is opened or closed based on the electrical contact or isolation between the cartridge terminals 140Y, 140M, 140C and 140K and the terminal members 210Y, 210M, 210C and 210K, without the need for the provision of the conventionally employed physical switch (es) between the door member 13 and the body housing 10.

When the user closes the door member 13 that had been open, the terminal members 210Y, 210M, 210C and 210K contact the respective cartridge terminals 140Y, 140M, 140C and 140K, with the above described configuration according to an embodiment, in the order of black, cyan, magenta and yellow.

According to an embodiment, as the magenta terminal member 210M comes into a contact with the magenta cartridge terminal 140M, the fifth terminal 215M makes contact with the fifth cartridge terminal 145M, enabling the controller 300 to detect the conduction of the second detection power through the second detection power terminal PS2, and to hence allow the HVPS 93 and the SMPS 91 to output the high voltage(s) and the 24V voltage, respectively.

As the door member 13 closes further to bring the yellow terminal member 210Y in contact with the yellow cartridge terminal 140Y, the fifth terminal 215Y makes contact the fifth cartridge terminal 145Y, enabling the controller 300 to detect the first detection power through the first detection power terminal PS2 being conducted, and to thus allows the SMPS 91 to output the 5V voltage.

In this manner, when the door member 13 is closed, the operations of various components of the image forming apparatus 1 can be restarted to perform the printing operation.

While an embodiment is described above that employs two terminal pairs, that is, the yellow and magenta fifth cartridge terminals 145Y and 145M and the corresponding fifth terminals 215Y and 215M, are employed for the purposes of the detection of the closure state of the door member 13, it should be understood that alternative embodiments employing only a pair or three or more pairs of terminals are also possible.

For example, according to another embodiment of the present disclosure, a pair of terminals, for example, one of the fifth cartridge terminals 145Y and 145M paired with the corresponding one of the fifth terminals 215Y and 215M, may be employed for the purposes of detecting the closure status of the door member 13.

Figure 6:
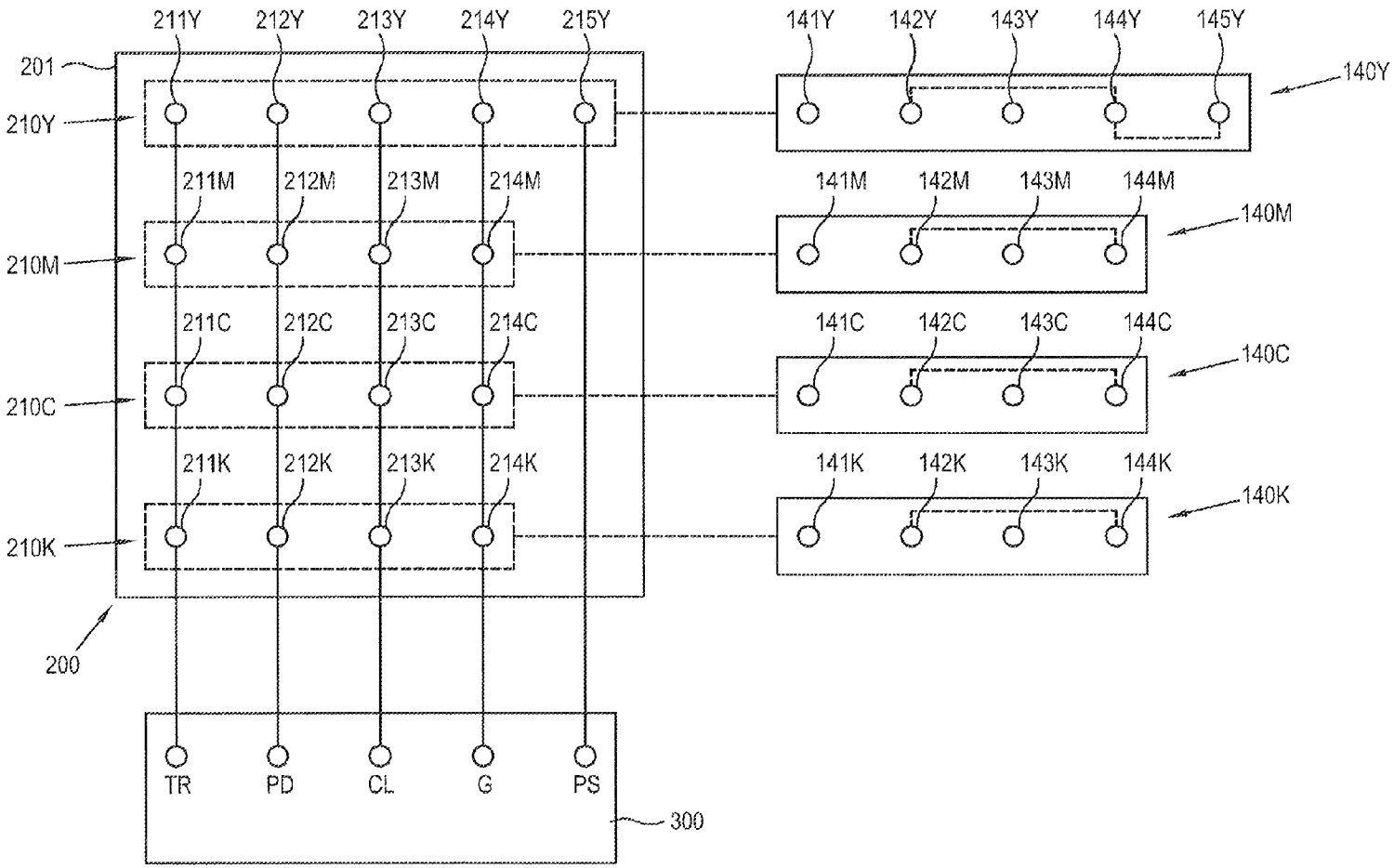
FIG. 6 is a schematic view illustrative of the configuration of the electrical connections between the controller, the terminal member and the cartridge terminal of an image forming apparatus according to another embodiment of the present disclosure.

As shown in FIG. 6, the developing cartridges 100Y, 100M, 100C and 100K according to an embodiment may respectively include the first cartridge terminals 141Y, 141M, 141C and 141K, the second cartridge terminals 142Y, 142M, 142C and 142K, the third cartridge terminals 143Y, 143M, 143C and 143K, and the fourth cartridge terminals 144Y, 144M, 144C and 144K. In addition, on the door member 13 may be provided the first terminals 211Y, 211M, 211C and 211K, the second terminals 212Y, 212M, 212C and 212K, the third terminals 213Y, 213M, 213C and 213K and the fourth terminals 214Y, 214M, 214C and 214K in correspondence to the respective cartridge terminals of the cartridge terminal members 140Y, 140M, 140C and 140K. These terminal components have substantially the same configuration as those previously described, and therefore need not be repeatedly described.

According to the embodiment, the yellow cartridge terminal 140Y may further include the fifth cartridge terminal 145Y, whereas the yellow terminal member 210Y may be provided with the fifth terminal 215Y.

The controller 300 may include a detection power terminal PS, through which detection power of a predetermined level of voltage is output to the fifth terminal 215Y. When the door member 13 is closed, the controller 300 may output operational power for the cartridge status chips 130Y through the second terminals 212Y, 212M, 212C and 212K, and may output the detection power through the fifth terminal 215Y. In this example, the fourth cartridge terminal 144Y may be provided to form a common cathode along with the second cartridge terminal 142Y and the fifth cartridge terminal 145Y.

When the detection power through the fifth cartridge terminal 145Y and the fifth terminal 215Y is interrupted, the controller 300 determines that the door member 13 is opened. Accordingly, the controller 300 blocks the power output of the power supplying unit 90.

On the other hand, when the detection power is transmitted through the fifth cartridge terminal 145Y and the fifth terminal 215Y, the controller 300 determines that the door member 13 is closed. Accordingly, the controller 300 allows the power supplying unit 90 to output power.

In this manner, by applying a detection power application circuit configuration in the cartridge terminals 140Y, 140M, 140C and 140K and the terminal members 210Y, 210M, 210C and 210K as described above, it is possible to determine the closure status of the door member 13 based on the transmission status of the detection power. According to yet another alternative embodiment, the controller 300 may use the fact that power is being drawn from PD terminal as an indication that the door is closed.

While a detailed structure of the controller 300 is not depicted in the figures, as would be readily understood by those skilled in the art, the controller 300 may be, e.g., a microprocessor, a microcontroller or the like, that may include a central processing unit (CPU) to execute one or more computer instructions to implement the various control operations herein described and/or control operations relating to the other components of the image forming apparatus 1, such as, for example, one or more of the medium supplying unit 20, the exposure unit 40, the transfer unit 50, fixing unit 60 and the discharging unit 70, and to that end may further include a memory device, e.g., a Random Access Memory (RAM), Read-Only-Memory (ROM), a flesh memory, or the like, to store the one or more computer instructions.

While the disclosure has been particularly shown and described with reference to several embodiments thereof with particular details, it will be apparent to one of ordinary skill in the art that various changes may be made to these embodiments without departing from the principles and spirit of the invention, the scope of which is defined in the following claims and their equivalents.

What is claimed is:

1. An image forming apparatus, comprising:

a body housing having formed thereon an opening;

a door member moveable so as to selectively open and close the opening;

at least one developing cartridge detachably receivable in the body housing through the opening, the at least one developing cartridge including a cartridge status chip having stored therein an operational state information relating to the at least one developing cartridge;

at least one terminal member arranged on the door member so as to come into contact with at least one cartridge terminal provided on the cartridge status chip when the door member is closed; and a controller electrically connected to the at least one terminal member, the controller being configured to make available an electrical power for, and to receive the operational state information from, the cartridge status chip through the contact between the at least one terminal member and the at least one cartridge terminal of the cartridge status chip, the controller being further configured to determines whether the door member is opened or closed based on whether the electrical power made available is being consumed.

2. The image forming apparatus according to claim 1, wherein the controller determines that the door member is closed if it is determined that the electrical power is being consumed, and determines that the door member is opened if it is determined that the electrical power is not being consumed.

3. The image forming apparatus according to claim 2, further comprising a power supplying unit received in the body housing, the power supplying unit being configured to output an operational electrical power with which to operate one or more components of the image forming apparatus, wherein the controller is configured to prevent the power supplying unit from outputting the operational electrical power if it is determined that the door member is opened and to allow the power supplying unit to output the operational electrical power if it is determined that the door member is closed.

4. The image forming apparatus according to claims 1, wherein the cartridge status chip includes a customer replaceable unit monitor (CRUM) memory storing therein the operational state information.

5. The image forming apparatus according to claim 1, wherein the at least one cartridge terminal each includes:

a first cartridge terminal through which the operational sate information is transmitted;

a second cartridge terminal through which an operating supply power is received, with which operating supply power the cartridge status chip being operable to provide the operational state information to the controller; and a third cartridge terminal configured to receive therethrough the electrical power made available by the controller, wherein the controller determines that the door member is open based at least in part on determination that the electrical power is not being drawn by the third cartridge terminal.

6. The image forming apparatus according to claim 5, wherein the at least one cartridge terminal further includes a fourth cartridge terminal connected to a common ground for the operating supply power and the electrical power.

7. The image forming apparatus according to claim 5, wherein the at least one developing cartridge comprises a plurality of developing cartridges each containing developer of a color different from developer contained in other ones of the plurality of developing cartridges, and wherein the at least one terminal member comprises a plurality of terminal members corresponding to the plurality of developing cartridges, the plurality of terminal members each being configured to come into contact with the at least one cartridge terminal of the cartridge status chip of respective corresponding one of the plurality of developing cartridges.

8. The image forming apparatus according to claim 7, further comprising a power supplying unit configured to output a plurality of levels of voltages each for operating different one or more components of the image forming apparatus, wherein the controller is configured to sequentially block ones of the plurality of levels of voltages from being applied to corresponding ones of the one or more components of the image forming apparatus based on an order in which the third cartridge terminal of ones of the plurality developing cartridges is released from corresponding ones of the plurality of terminal members.

9. An image forming apparatus having an access opening formed on a main housing thereof for providing mounting access therethrough of one or more removable components of the image forming apparatus, comprising:

a door coupled to the main housing in such a manner as to be moveable selectively to open and to close the access opening;

one or more electrical contact terminals arranged on a side of the door facing the access opening in such a manner the one or more electrical contact terminals come into an electrical contact with at least one of component contact terminals formed respectively on the one or more removable components received in the main housing when the door is closed; and a controller configured to control operation of the image forming apparatus based at least in part on a determination of whether an electrical current flows through the one or more electrical contact terminals.

10. The image forming apparatus of claim 9, wherein the one or more electrical contact terminals comprises a first electrical contact terminal and a second electrical contact terminal, and wherein the controller is configured to interrupt supply of power to a first internal component of the image forming apparatus in response to determination that no electrical current is flowing through the first electrical contact terminal and to interrupt supply of power to a second internal component of the image forming apparatus in response to determination that no electrical current is flowing through the second electrical contact terminal.

11. The image forming apparatus of claim 10, wherein an operating voltage of the first internal component of the image forming apparatus is higher than that of the second internal component of the image forming apparatus, and wherein the door is rotatable about a rotational axis, the first electrical contact terminal being positioned further away from the rotational axis of the door than the second electrical contact terminal.

12. The image forming apparatus of claim 10, wherein the first internal component of the image forming apparatus is configured to emit a light, and wherein the door is rotatable about a rotational axis, the first electrical contact terminal being positioned furthest away from the rotational axis of the door among all of the one or more electrical contact terminals.

13. The image forming apparatus of claim 9, wherein the one or more removable components comprises a developer cartridge in which a supply of developer of at least one color is stored.

14. A removable component unit of an image forming apparatus detachably receivable in a main housing of the image forming apparatus through an access opening formed on the main housing that includes a door for selectively closing the access opening, comprising:

a unit housing having housed therein a memory device in which information relating to the removable component unit is stored; and at least one electrical contact terminal arranged on the unit housing so as to be engageable with an electrical terminal provided on the door, the at least one electrical contact terminal forming at least a part of an electrical current path between the at least one electrical contact terminal and an electrical ground to which a ground terminal of the memory device is connected.

15. The removable component unit of claim 14, wherein the removable component unit comprises a developer cartridge in which a supply of developer of at least one color is stored, the memory device comprising a customer replaceable unit monitor (CRUM) memory for storing therein information relating to an amount of developer contained in the developer cartridge.

16. The removable component unit of claim 15, wherein the developer cartridge contains yellow color developer.

17. The removable component unit of claim 15, wherein the developer cartridge contains magenta color developer.

18. The removable component unit of claim 14, wherein the at least one electrical contact terminal comprises a first electrical contact terminal for receiving therethrough an operating supply voltage for the memory device and a second electrical contact terminal different from the first electrical contact terminal.

19. The removable component unit of claim 18, wherein the electrical current path between the at least one electrical contact terminal and the electrical ground comprises a resistive current path.

20. The removable component unit of claim 14, wherein the at least one electrical contact terminal comprises at least two electrical contact terminals that are electrically connected with each other.

* * * * *

UNITED STATES PATENT AND TRADEMARK OFFICE

CERTIFICATE OF CORRECTION

PATENT NO. : 8,260,157 B2
APPLICATION NO. : 12/782243
DATED : September 4, 2012
INVENTOR(S) : Kyoung-Seok Kim et al.

It is certified that error appears in the above-identified patent and that said Letters Patent is hereby corrected as shown below:

In the Claims:

Column 15, Line 13, In Claim 4, delete “claims” and insert -- claim --, therefor.
Column 15, Line 20, In Claim 5, delete “sate” and insert -- state --, therefor.

Signed and Sealed this
Seventh Day of May, 2013

Teresa Stanek Rea
*Acting Director of the United States Patent and Trademark Office*